US007101327B1

(12) United States Patent
Baumler et al.

(10) Patent No.: US 7,101,327 B1
(45) Date of Patent: Sep. 5, 2006

(54) EXERCISE DEVICE WITH ADJUSTABLE PRESS ARM

(75) Inventors: Thomas K. Baumler, Forest Lake, MN (US); Nathan R. Luger, Roseville, MN (US)

(73) Assignee: Brunswick Corporation, Lake Forest, IL (US)

( * ) Notice: Subject to any disclaimer, the term of this patent is extended or adjusted under 35 U.S.C. 154(b) by 576 days.

(21) Appl. No.: 10/384,135

(22) Filed: Mar. 7, 2003

(51) Int. Cl.
*A63B 21/062* (2006.01)

(52) U.S. Cl. ..... 482/136; 482/100; 482/137; 482/908

(58) Field of Classification Search ..... 482/99–103, 482/135–138, 908
See application file for complete search history.

(56) References Cited

U.S. PATENT DOCUMENTS 5,643,152 A * 7/1997 Simonson ..... 482/100
5,681,247 A * 10/1997 Webber ..... 482/100
5,823,920 A * 10/1998 Grider ..... 482/100

* cited by examiner

*Primary Examiner*—Glenn E. Richman
(74) *Attorney, Agent, or Firm*—Andrus, Sceales, Starke & Sawall, LLP

(57) ABSTRACT

An exercise device includes a frame, a press arm pivotally attached to the frame at a main pivot, a pair of press handles extending from the press arm, an adjustment link having a first portion pivotally mounted to the press arm at an adjustment pivot between the main pivot and the press handles, and having a second portion adjustably extensible and retractable from the first portion, a bracket mounted to the second portion of the adjustment link and guided by the frame for movement therealong, and a pulley mounted to the bracket and receiving a cable trained therearound from a source of resistance.

30 Claims, 9 Drawing Sheets

EXERCISE DEVICE WITH ADJUSTABLE PRESS ARM

BACKGROUND AND SUMMARY OF THE INVENTION

The invention relates to exercise devices with a press arm, e.g. for shoulder rotary press and other exercises, and more particularly to improved adjustment therefor.

For exercise equipment with a decline or flat to shoulder rotary pressing station, it is necessary to have a press arm whose starting position can be adjusted. It is also advantageous that no tension be put on the cabling that is linked to a source of resistance, e.g. a weight stack, during any of the starting positions, since this would necessitate a secondary adjustment with the cabling for the weight stack. In the prior art, some manufacturers have put a secondary pivot at some point between the press arm main pivot and the press handle. The pulleys and cables linked to the weight stack are attached at some point between such pivots so that the cable is never put in tension at any starting point. In such arrangement, the distance from the press handles to the main pivot of the press arm changes for each starting position, and because of this, the weight ratio is different for each starting position, which is a disadvantage. More adjustments are sometimes required to the bench and to put the user in the correct position to perform the exercise in such type of system.

In one known attempt to solve the above-noted problem, an adjustable floating link is pivotally connected to the press arm half way between the press handles and the main pivot. A pulley is attached at the bottom of the link by a cable wrapped therearound providing 1:1 resistance. When the press arm is at rest, the link stops somewhere on the frame so that when the press arm is adjusted with the adjustable link, the pulley never changes position. While the resistance profile was the same for all press positions, and the system allowed for minimal adjustments to the bench, this type of press station was not perceived well by consumers. The floating link would tend to swing back and forth when performing chest exercises, and the press station was perceived as unstable.

A known improvement to the above-noted floating pendulum adjustable link press arm adds two more links, one of them being adjustable. In this four bar linkage, two of the links remain stationary, while the press arm (being one of the links) and an adjustable link (being the fourth link) move while the starting position is adjusted. One of the stationary links is typically part of the frame, and the other stationary link is the attachment point for the cable and/or pulley. The press arm can then be adjusted without putting any tension on the cable system, and the distance from the main pivot to the press handles never changes. The disadvantage in this system is that by adding extra pivots for the linkages, more friction is introduced to the mechanism, and more cost.

The present invention accomplishes the above-noted goals without the noted added friction nor the noted added pendulum motion, and with a more cost-effective construction and mechanism. A simplified construction is provided by a frame, a press arm, and an adjustable link. The adjustable link has a pulley over which a cable passes, linking it to the source of resistance, such as a weight stack. The adjustment link is pivotally connected to the press arm between the main pivot and the press handles. The cable wraps around the pulley, which allows for a 1:1 weight resistance relationship with the cable. This is similar to the floating link system described above, except that the pulley on the present adjustable link is guided by a frame member for movement therealong, and in the preferred embodiment rolls thereon. By strategically placing the noted frame member and the coupling directional pulleys on the frame, the direction of force on the linkage causes the linkage pulley to ride on the frame member. The contact of the linkage pulley against the frame stops the adjustable link from floating. When the press arm is at rest, the adjustable link is stopped by and rests on the frame. As it is stopped, gravity pulls the adjustable link rearwardly, disengaging the pulley from contact with the frame. This allows the cable routed over such pulley to be used with a different exercise when the press arm is not in use. The rotation of the pulley caused by the cable is in the same rotational direction caused by it rolling along the frame member. The invention keeps the press handles in the same position relative to the main pivot, and does not introduce additional friction due to more pivots, and produces a stable pressing motion because the adjustment link does not float. The invention also enables economy of manufacture because of fewer parts.

DETAILED DESCRIPTION

Figure 1:
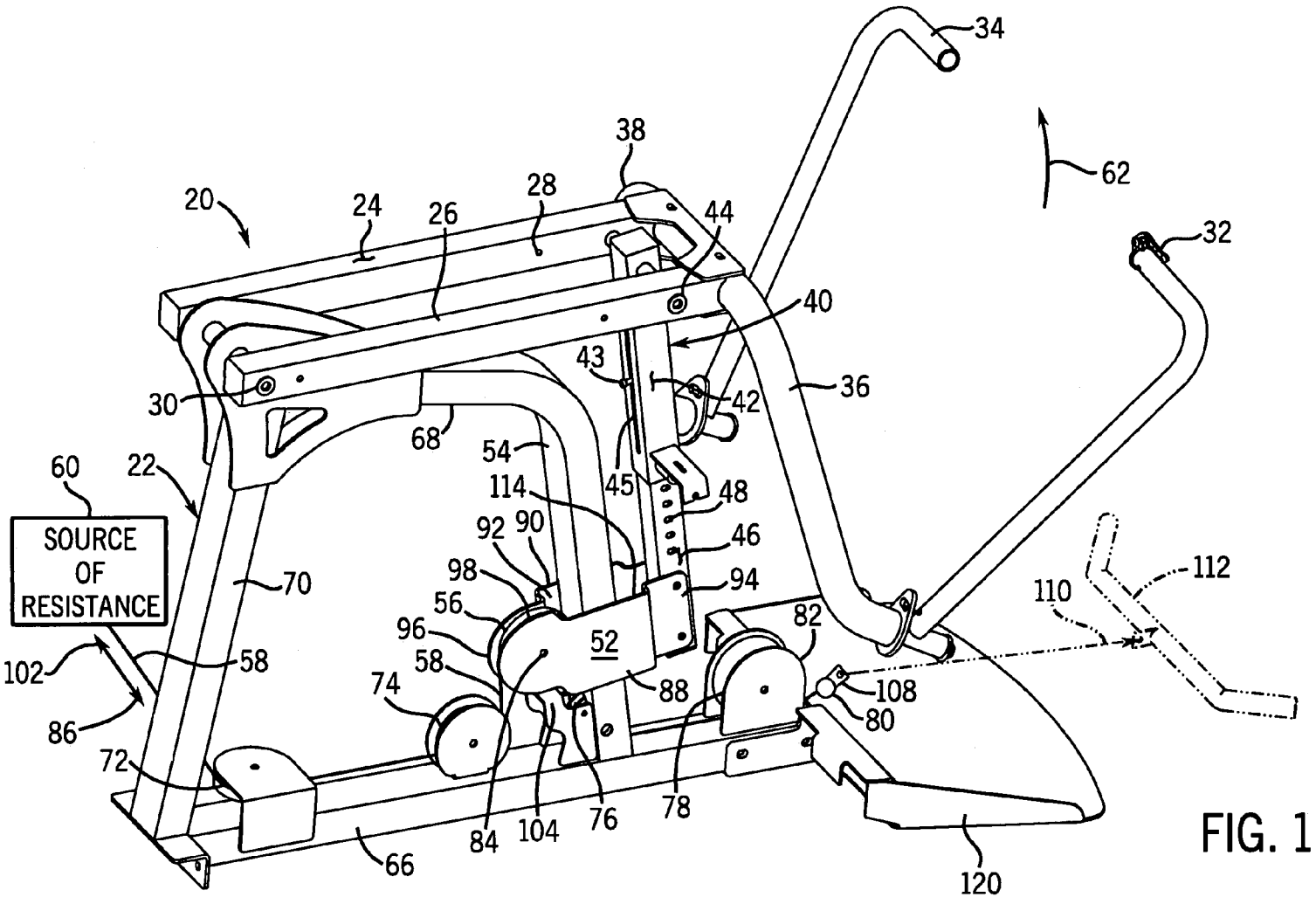
FIG. 1 is a perspective view of an exercise device in accordance with the invention.

FIG. 1 shows an exercise device 20 including a frame 22, a press arm 24, including right and left segments 26 and 28, pivotally attached to the frame at a main pivot 30, and a pair of press handles 32 and 34 extending from the press arm at the respective extensions 36 and 38 of the handles. An adjustment link 40 has a first upper portion 42 pivotally mounted to the press arm at an adjustment pivot 44 between main pivot 30 and press handles 32, 34, and has a second lower portion 46 adjustably extensible and retractable from upper portion 42. In preferred form, adjustment link 40 is provided by first and second tubular members 42 and 46 telescopically and adjustably slidable along each other, and a retractable transverse locking pin 48, FIGS. 8, 9 extending through indexing holes 50 in one of the tubular members to adjust telescopic extension and retraction. A guide pin 43 may extend from portion 46 through longitudinal slot 45 in portion 42 for added guidance and telescopic registry if desired.

A bracket 52, FIG. 1 is mounted to second portion 46 of adjustment link 40 and is guided by frame member 54 for movement therealong. A pulley 56 is mounted to bracket 52 and receives a cable 58 trained therearound from a source of resistance 60, e.g. a weight stack or the like. Pivotal movement of press arm 24 by press handles 32, 34 in a first direction about main pivot 30, e.g. upwardly as shown at arrow 62 in FIG. 1, moves bracket 52 and pulley 56 upwardly along frame member 54, as shown in the upwardly translated position of bracket 52 and pulley 56 in FIG. 3 as compared to FIG. 2. Upward movement of pulley 56 is resisted by the source of resistance 60. During upward pivotal movement of press arm 24 from the position shown in FIG. 2 to the position shown in FIG. 3, second lower portion 46 of the adjustment link at bracket 52 moves along frame member 54. Press arm 24 and press handles 32, 34 are pivotally adjustable relative to main pivot 30 upon extension and retraction of second portion 46 relative to first portion 42. This allows a user lying on bench 64 to adjust the starting position, FIG. 2, of press handles 32, 34. The distance between main pivot 30 and press handles 32, 34 remains constant during pivotal movement of press arm 24 about main pivot 30 and also remains constant during pivotal adjustment of press arm 24 and press handles 32, 34 relative to main pivot 30 during adjustment extension and retraction of second portion 46 relative to first portion 42. Press handles 32, 34 are non-pivotally mounted to press arm segments 26, 28 by extensions 36, 38, respectively.

Figure 2:
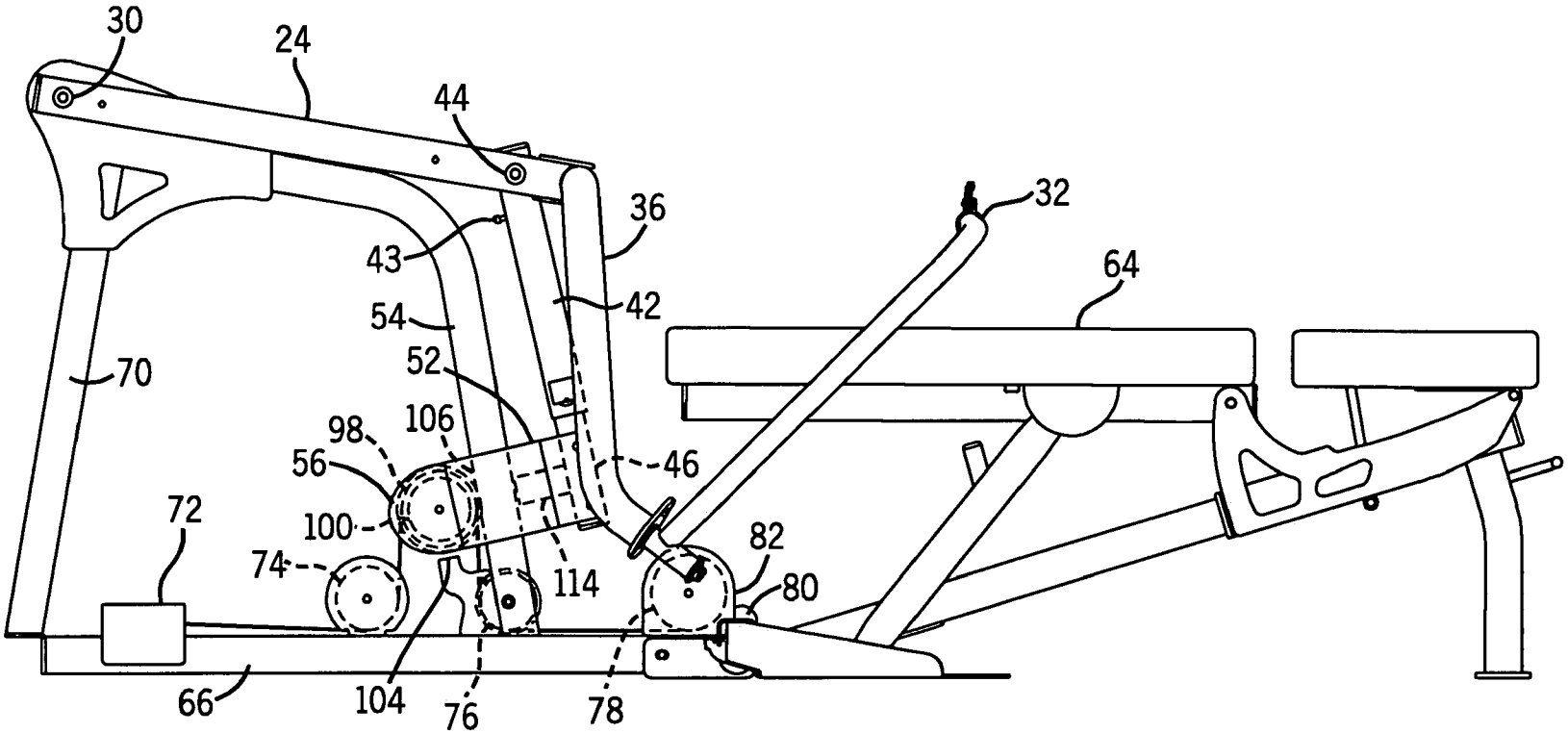
FIG. 2 is a side elevation view of the device of FIG. 1 and including a bench.
Figure 3:
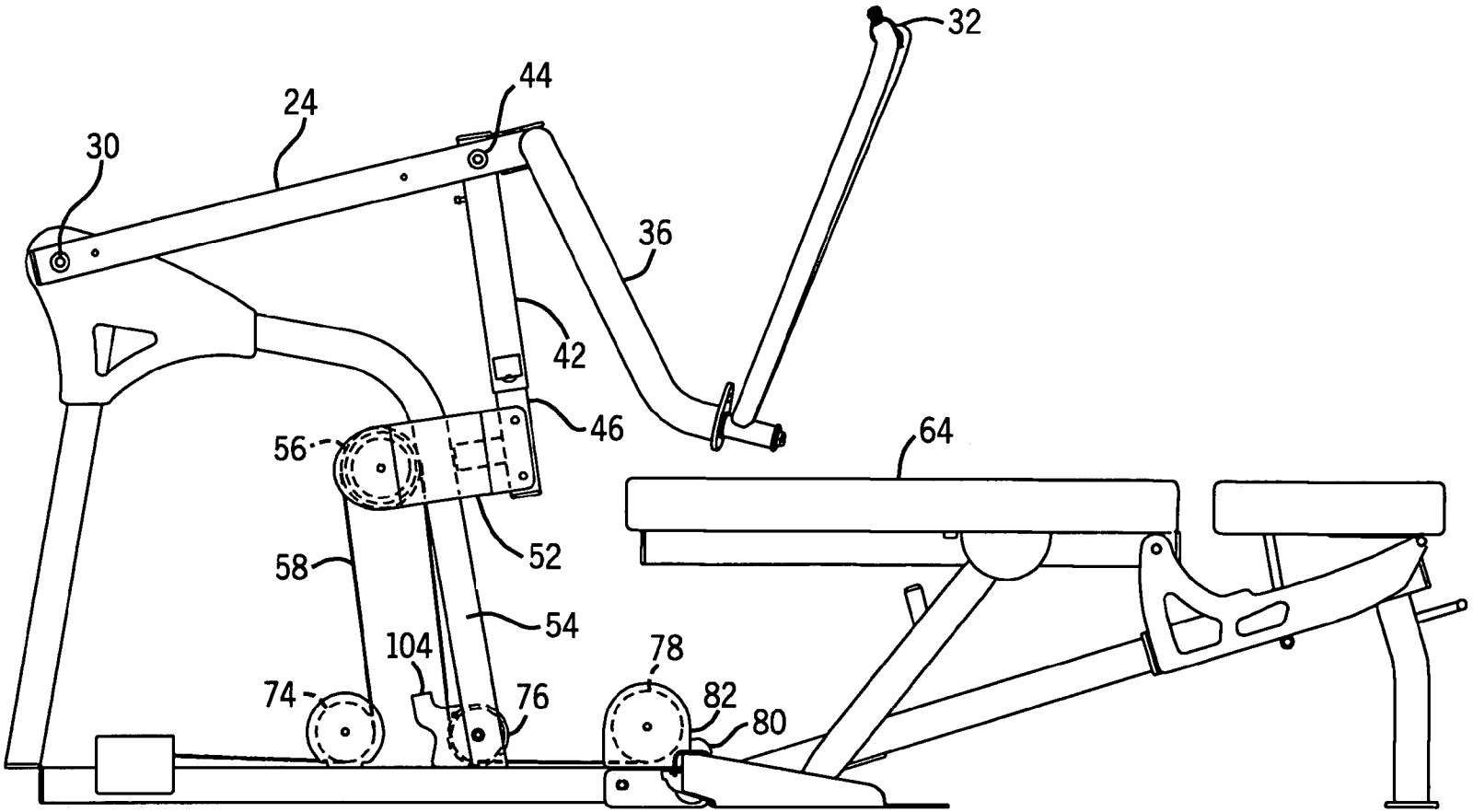
FIG. 3 is like FIG. 2 and illustrates sequential operation.

Frame 22 includes a lower horizontal base member 66, FIG. 1, extending horizontally and resting on the floor, a support member 54 extending upwardly therefrom at a slight rearward angle and then curved rearwardly at 68 to join with upstanding frame member 70 to support main pivot 30. Support member 54 cooperates with bracket 52 and guides the bracket for movement therealong such that second lower portion 46 of adjustment link 40 has a constrained path of travel defined by support member 54 of the frame. Cable 58 from source of resistance 60 is trained around pulley 72 mounted to the frame, then around pulley 74 mounted to the frame, then around pulley 56 mounted to bracket 52, then around pulley 76, FIG. 2, mounted to the frame, and then passes below pulley 78 mounted to the frame, and terminates at ball end 80. In the orientation of FIGS. 1–3, leftward movement of the terminating cable end at ball 80 is prevented by engagement of ball 80 with pulley bracket 82, whereby such cable end is fixed to the frame against leftward movement thereof. Upward movement of press handles 32, 34 pivots press arm 24 upwardly about main pivot 30 against the resistance of the source of resistance 60 by translating bracket 52 upwardly along support member 54 such that pulley 56 rolls upwardly along support member 54 against the resistance of the source of resistance 60. During such movement, cable terminating end 80 is fixed as noted, and pulley 56 rotates about its rotational axis 84 and cable 58 is pulled upwardly to in turn pull cable 58 from the source of resistance 60 in the direction shown at arrowhead 86, which movement is resisted by source of resistance 60.

Bracket 52 has right and left sides 88 and 90 having a central passage 92 therebetween receiving support member 54. Sides 88, 90 have a front end 94 mounted to second lower portion 46 of adjustment link 40, and have a rear end 96 mounting pulley 56. Bracket 52 surrounds support member 54, with the right and left sides 88 and 90 of the bracket on distally opposite sides of support member 54, and with the second portion 46 of the adjustment link and the pulley 56 on distally opposite forward and rearward ends, respectively, of support member 54. Pulley 56 has the noted central rotation axis 84 and is mounted to bracket 52 at such axis, and has a circumferential groove 98 receiving cable 58, and has an outer circumference 100 on laterally opposite sides of the groove and spaced radially outwardly thereof by a radial dimension greater than the radial thickness of cable 58 in the groove, such that pulley 56 at outer circumference 100 engages and rolls along support member 54 of the frame during pivotal movement of press arm 24 about main pivot 30.

Pulley 74 is mounted to the frame at base member 66 below pulley 56 and guides cable 58 from the source of resistance 60 to pulley 56. Pulley 76 provides a cable guide below pulley 56 and guiding cable 58 from pulley 56. In an alternate embodiment, pulleys 76 and 78 are eliminated, and the cable is terminated at and fixed to the frame at an attachment point below pulley 56. Pulley 74 and the cable guide provided by pulley 76 (or by fixed attachment of the terminating cable end to the frame below pulley 56) trains cable 58 around pulley 56 at an orientation strategically selectable to provide a direction of force on pulley 56 causing pulley 56 to ride on support member 54 such that pulley 56 rolls upwardly along support member 54 and is slightly biased into engagement with support member 54 during such upward rolling. Cable 58 extends downwardly from pulley 56 between pulley 56 and support member 54 to the cable guide provided by pulley 76 therebelow as pulley 56 rolls along support member 54. It is preferred that support member 54 extend upwardly from base member 56 at a slight rearward angle as noted above.

Pulley 56 rolls downwardly along support member 54 as urged by the source of resistance 60 pulling cable 58 in the direction shown by arrowhead 102 and also as urged by gravity to a lower translational travel limit as stopped by bracket 52 engaging lower stop 104 on the frame. In this lower position, pulley 56 slightly disengagingly separates from support member 54 to provide a small gap 106 therebetween, to in turn allow rotation of pulley 56 without rolling along support member 54. This is desirable to enable additional exercises, by attaching terminating ball end 80 of the cable at tab 108 as shown at arrow 110 to an exercise accessory 112, such as a handlebar, rope pull, etc., to pull cable 58 against the resistance of the source of resistance 60 while pulley 56 is at its lower translational travel limit and disengaged from support member 54. To limit rearward movement of lower portion 46 of the adjustment link as pulley 56 disengagingly separates from support member 54 at the lower limit of travel of bracket 52 as it engages stop 104, a stop 114, FIG. 2, is provided on lower portion 46 extending rearwardly therefrom to engage support member 54 and limit rearward movement of lower portion 46 of adjustment link 40. This provides firm positioning of pulley 56 without floating or wobbling thereof during the noted alternate exercises as cable end 80 is pulled rightwardly and/or upwardly in the orientation of FIGS. 1–5.

Figure 4:
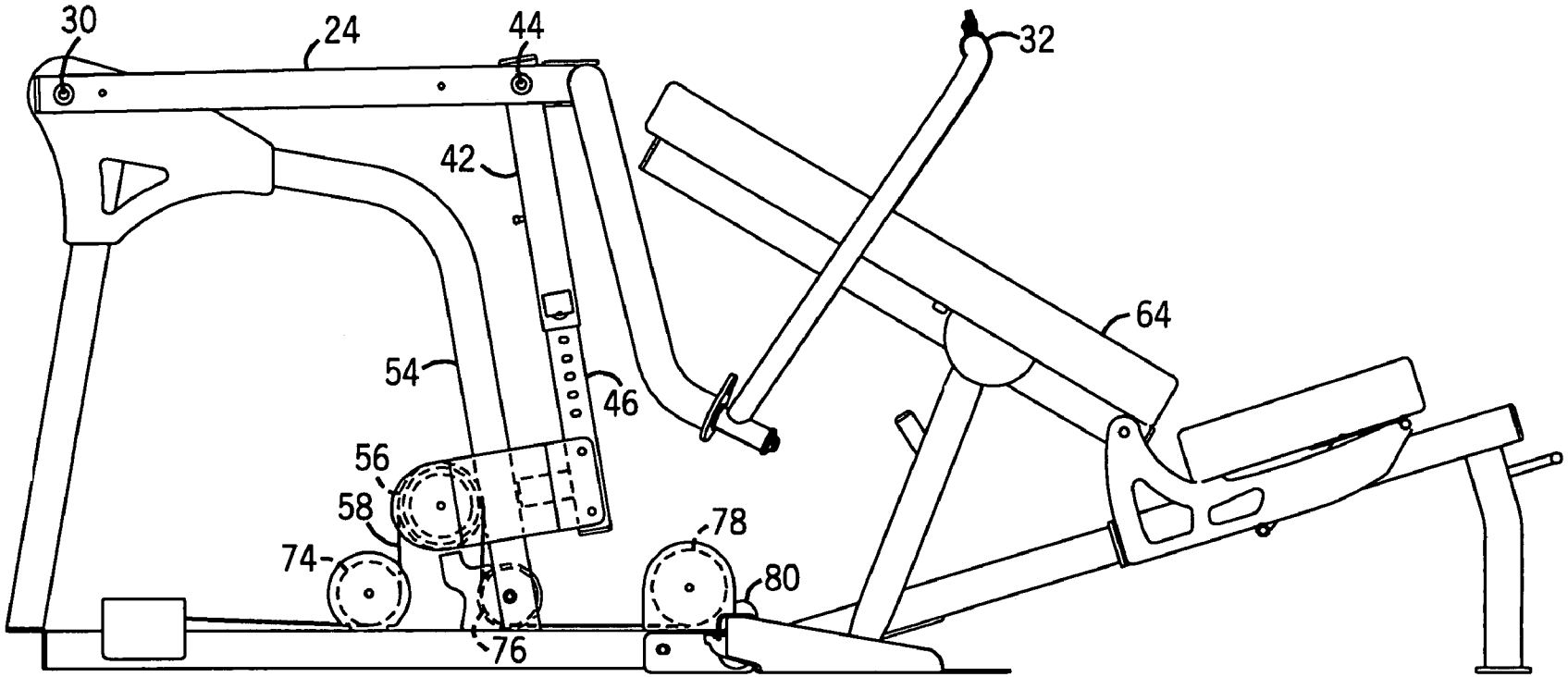
FIG. 4 is like FIG. 2 and shows another exercise position.
Figure 5:
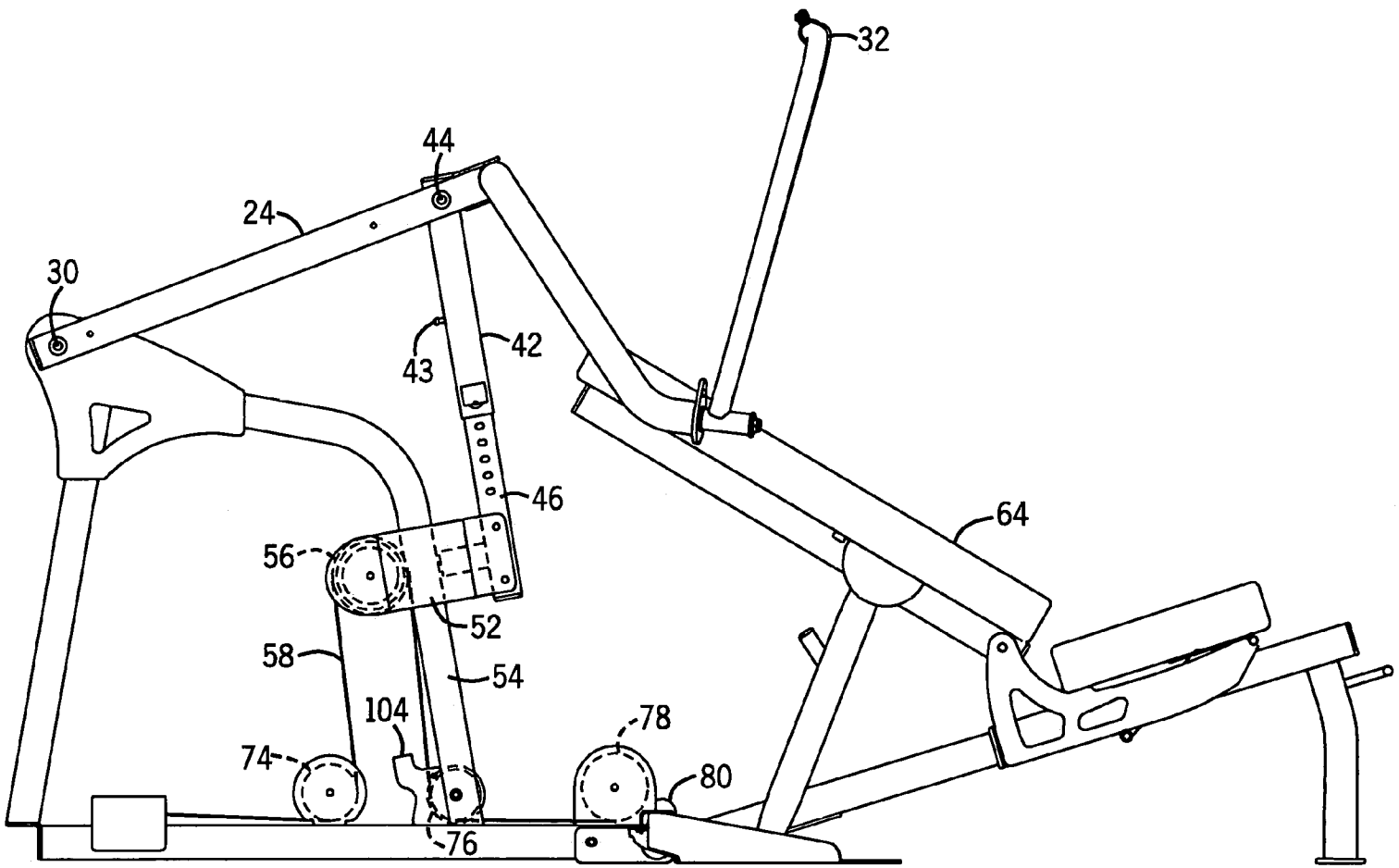
FIG. 5 is like FIG. 4 and illustrates sequential operation.

FIGS. 4 and 5 illustrate a different exercise position for the user wherein the back support portion of bench 64 is tilted upwardly relative to the flat position shown in FIGS. 2 and 3. Press handles 32, 34 are adjusted to a higher starting position in FIG. 4 relative to FIG. 2 as shown by transverse locking pin 48 engaging an indexing hole 50 at a higher point along second lower portion 46 of adjustment link 40. In each of the differently adjusted positions of press arms 32, 34 in FIGS. 2 and 4, the distance between main pivot 30 and press handles 32, 34 remains the same. Furthermore, in each of the different pivoted positions of press arm 24 in FIGS. 2 and 3, and in each of the different pivoted positions of press arm 24 in FIGS. 4 and 5, the distance between main pivot 30 and press handles 32, 34 remains the same.

Figure 6:
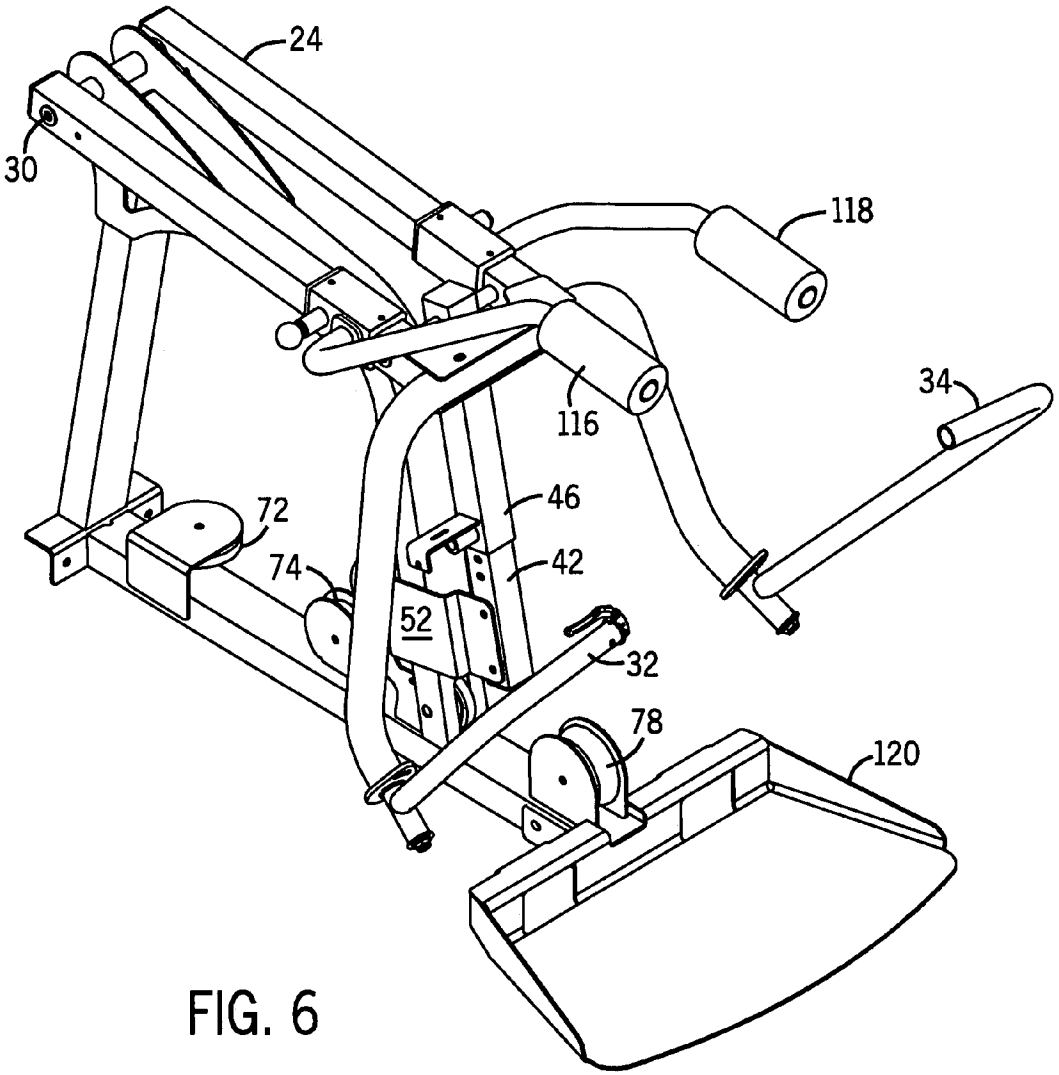
FIG. 6 is a perspective view of a further embodiment of an exercise device in accordance with the invention.
Figure 7:
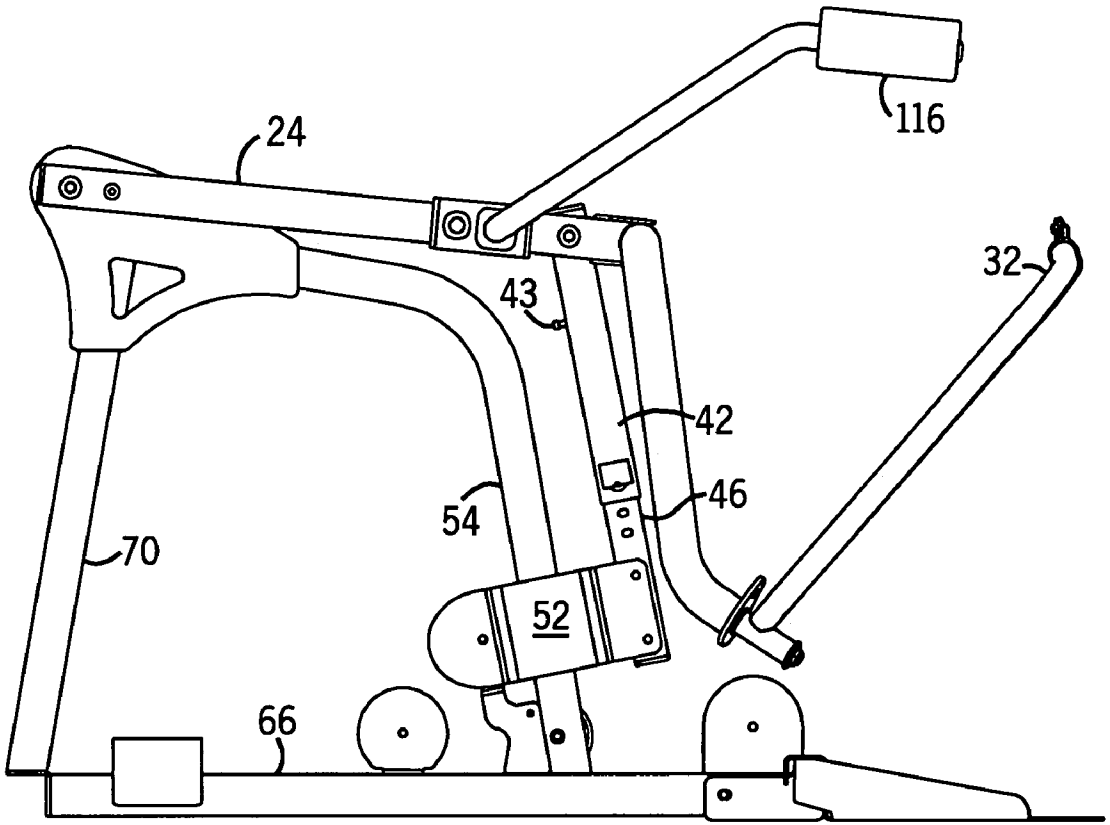
FIG. 7 is a side elevation view of the device of FIG. 6.

FIGS. 6 and 7 show an alternate embodiment having a pair of shoulder bars 116 and 118 extending from the respective segments 26 and 28 of press arm 24 above the press handles for engagement by a user's shoulders for squat exercises. In this exercise, bench 64 is removed. To facilitate removal and later replacement of bench 64, a docking system including a lower foot plate docking channel guide 120 may be used as set forth in commonly owned U.S.

patent application Ser. No. 10/386,177, filed on even date herewith, incorporated herein by reference.

Figure 9:
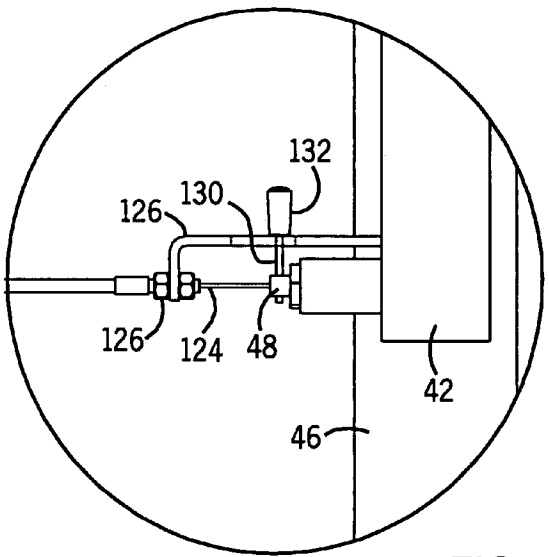
FIG. 9 is an enlarged elevation view of a portion of FIG. 8.
Figure 8:
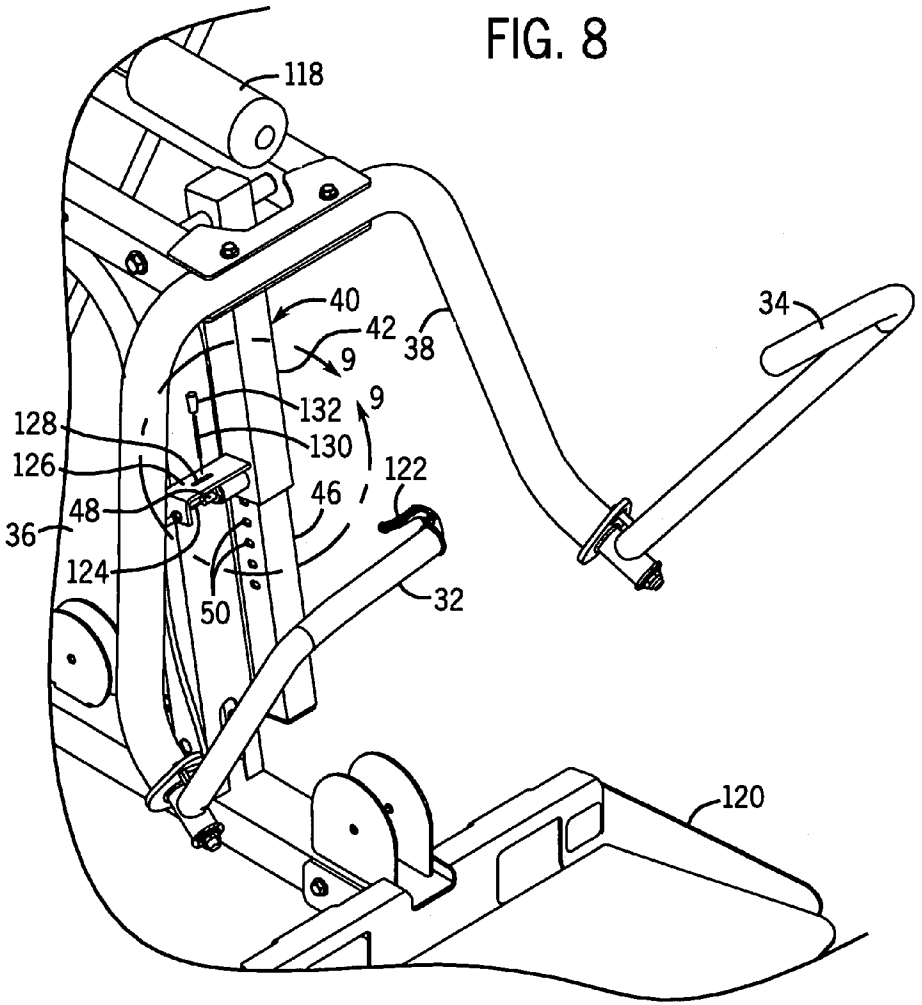
FIG. 8 is an enlarged view of a portion of FIG. 6.

As shown in FIGS. 8 and 9, one of the press handles may include a remote lever handle 122 connected by a push-pull cable 124 to locking pin 48 at bracket 126 on portion 42 of adjustment link 40, for remote actuation of adjustment locking pin 48. Bracket 126 has a slot 128 receiving pin 130 therethrough from knob 132 for local actuation of locking pin 48.

Figure 10:
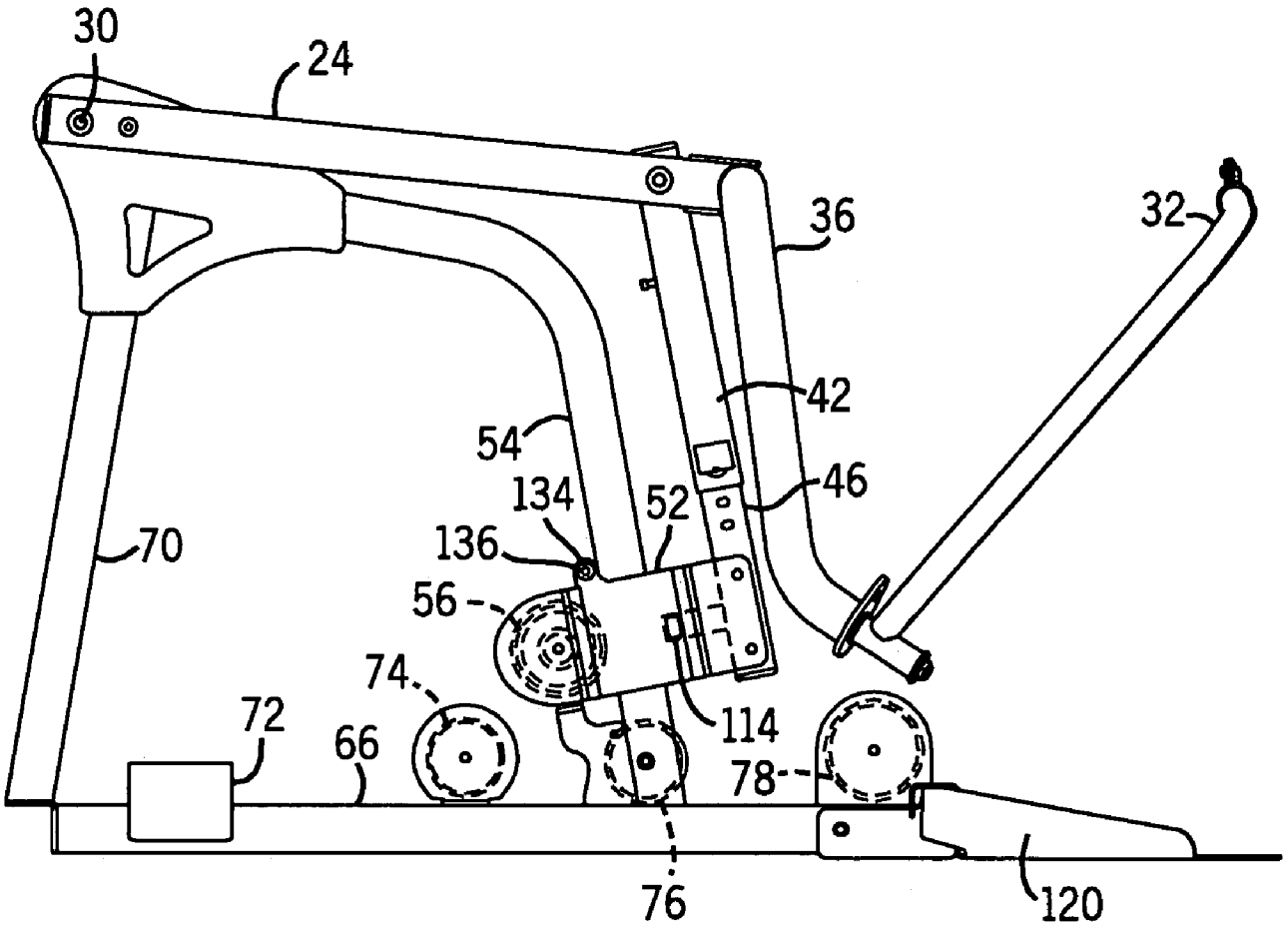
FIG. 10 is like FIG. 2 and shows an alternate embodiment.

FIG. 10 shows another embodiment and uses like reference numerals from above where appropriate to facilitate understanding. Roller 134 is provided on bracket 52 and journaled thereto to rotate about rotation axis 136. Roller 134 engages and rolls along support member 54 of the frame during pivotal movement of press arm 24 about main pivot 30. Pulley 74 is mounted to the frame below pulley 56 and guides cable 58 from the source of resistance to pulley 56. The cable guide provided by pulley 76 mounted to the frame below pulley 56 guides the cable from pulley 56 and together with pulley 74 trains the cable around pulley 56 at an orientation providing a direction of force on bracket 52 causing roller 134 to ride on support member 54 such that roller 134 rolls upwardly along support member 54 and is biased into engagement with support member 54 during such upward rolling. Roller 134 rolls downwardly along support member 54 as urged by the source of resistance on pulley 56 and bracket 52 and by gravity to a lower translational travel limit of the bracket. Cable end 80 can be fixed to the frame, as above, such that upward movement of press handles 32, 34 pivots press arm 24 upwardly about main pivot 30 against the resistance of the source of resistance 60 by translating bracket 52 upwardly along support member 54 such that roller 134 rolls upwardly along support member 54 against the resistance of the source of resistance 60. Alternatively, cable end 80 can be attached to an exercise accessory 112, as above, to pull the cable against the resistance of the source of resistance while bracket 52 and pulley 56 are at their lower translational travel limit. Pulley 56 may roll along support member 54, as above, or alternatively pulley 56 may be spaced from support member 54 by a slight gap such that only roller 134 rolls along support member 54.

The invention has been illustrated in its preferred embodiment in conjunction with a shoulder press. The invention is also applicable to other exercise devices, including press exercise devices, such as a multi-press, such as a flat chest press, incline bench press, decline bench press, shoulder press, and the like.

It is recognized that various equivalents, alternatives and modifications are possible within the scope of the appended claims.

What is claimed is:

1. An exercise device comprising:

a frame;

a press arm pivotally attached to said frame at a main pivot;

a pair of press handles extending from said press arm;

an adjustment link having a first portion pivotally mounted to said press arm at an adjustment pivot between said main pivot and said press handles, and having a second portion adjustably extensible and retractable from said first portion;

a bracket mounted to said second portion of said adjustment link and guided by said frame for movement therealong;

a pulley mounted to said bracket and receiving a cable trained therearound from a source of resistance.

2. The exercise device according to claim 1 wherein pivotal movement of said press arm by said press handles in a first direction about said main pivot moves said bracket along said frame, which movement is resisted by said source of resistance, and wherein during said pivotal movement, said second portion of said adjustment link at said bracket moves along said frame, and wherein said press arm and said press handles are pivotally adjustable relative to said main pivot upon extension and retraction of said second portion of said adjustment link relative to said first portion of said adjustment link.

3. The exercise device according to claim 1 wherein the distance between said main pivot and said press handles remains constant during said pivotal movement of said press arm about said main pivot and also remains constant during pivotal adjustment of said press arm and said press handles relative to said main pivot during said extension and retraction of said second portion of said adjustment link relative to said first portion of said adjustment link.

4. The exercise device according to claim 3 wherein said press handles are non-pivotally mounted to said press arm.

5. The exercise device according to claim 2 wherein said frame includes a support member cooperating with said bracket and guiding said bracket for movement therealong such that said second portion of said adjustment link has a constrained path of travel defined by said support member of said frame.

6. The exercise device according to claim 5 wherein said cable extends beyond said pulley to a cable end fixed relative to said frame, such that movement of said press handles pivots said press arm about said main pivot against the resistance of said source of resistance by translating said bracket along said support member such that said pulley moves against said resistance.

7. The exercise device according to claim 5 wherein said bracket has right and left sides having a central passage therebetween receiving said support member, said sides having a front end mounted to said second portion of said adjustment link, said sides having a rear end mounting said pulley.

8. The exercise device according to claim 7 wherein said bracket surrounds said support member of said frame, with said right and left sides of said bracket on distally opposite sides of said support member, and with said second portion of said adjustment link and said pulley on distally opposite forward and rearward ends, respectively, of said support member.

9. The exercise device according to claim 5 wherein said pulley has a central rotation axis and is mounted to said bracket at said axis, and has a circumferential groove receiving said cable, and has an outer circumference spaced radially outwardly of said groove by a radial dimension greater than the radial thickness of said cable in said groove, and wherein said pulley at said outer circumference engages and rolls along said support member of said frame during said pivotal movement of said press arm about said main pivot.

10. The exercise device according to claim 9 comprising a second pulley mounted to said frame below said first mentioned pulley and guiding said cable from said source of resistance to said first pulley, and a cable guide mounted to said frame below said first pulley and guiding said cable from said first pulley, said second pulley and said cable guide training said cable around said first pulley at an orientation providing a direction of force on said first pulley causing said first pulley to ride on said support member such that said first pulley rolls upwardly along said support member and is biased into engagement with said support member during said upward rolling.

11. The exercise device according to claim 10 wherein said cable passes downwardly from said first pulley between said first pulley and said support member to said cable guide therebelow as said first pulley rolls along said support member.

12. The exercise device according to claim 11 wherein said cable guide is a third pulley.

13. The exercise device according to claim 10 wherein said first pulley rolls downwardly along said support member as urged by said source of resistance and by gravity to a lower translational travel limit and disengagingly separates from said support member at said lower limit.

14. The exercise device according to claim 13 wherein said cable guide is a third pulley and said cable extends beyond said third pulley to a cable end.

15. The exercise device according to claim 14 wherein said cable end is fixed to said frame, such that upward movement of said press handles pivots said press arm upwardly about said main pivot against the resistance of said source of resistance by translating said bracket upwardly along said support member such that said first pulley rolls upwardly along said support member against said resistance of said source of resistance.

16. The exercise device according to claim 14 wherein said cable end is attachable to an exercise accessory to pull said cable against the resistance of said source of resistance while said first pulley is at said lower translational travel limit and disengaged from said support member.

17. The exercise device according to claim 2 comprising a pair of shoulder bars extending from said press arm about said press handles for engagement by a user's shoulders for squat exercises.

18. The exercise device according to claim 2 wherein said first and second portions of said adjustment link comprise first and second tubular members telescopically and adjustably slidable along each other, and a retractable transverse locking pin extending through indexing holes in one of said tubular members to adjust telescopic extension and retraction.

19. The exercise device according to claim 18 comprising first and second actuators for said retractable transverse locking pin, comprising a first remote actuator on one of said press handles and coupled by a cable to said retractable transverse locking pin, and a second local actuator on said adjustment link and connected to said retractable transverse locking pin.

20. The exercise device according to claim 5 comprising a roller on said bracket engaging and rolling along said support member of said frame during pivotal movement of said press arm about said main pivot.

21. The exercise device according to claim 20 comprising a second pulley mounted to said frame below said first mentioned pulley and guiding said cable from said source of resistance to said first pulley, and a cable guide mounted to said frame below said first pulley and guiding said cable from said first pulley, said second pulley and said cable guide training said cable around said first pulley at an orientation providing a direction of force on said first pulley and said bracket causing said roller to ride on said support member such that said roller rolls upwardly along said support member and is biased into engagement with said support member during said upward rolling.

22. The exercise device according to claim 21 wherein said cable passes downwardly from said first pulley between said first pulley and said support member to said cable guide therebelow as said roller rolls along said support member.

23. The exercise device according to claim 22 wherein said cable guide is a third pulley.

24. The exercise device according to claim 21 wherein said roller rolls downwardly along said support member as said bracket is urged by said source of resistance on said first pulley and by gravity to a lower translational travel limit.

25. The exercise device according to claim 24 wherein said cable guide is a third pulley and said cable extends beyond said third pulley to a cable end.

26. The exercise device according to claim 25 wherein said cable end is fixed to said frame, such that upward movement of said press handles pivots said press arm upwardly about said main pivot against the resistance of said source of resistance by translating said bracket upwardly along said support member such that said roller rolls upwardly along said support member against said resistance of said source of resistance.

27. The exercise device according to claim 25 wherein said cable end is attachable to an exercise accessory to pull said cable against the resistance of said source of resistance while said bracket is at said lower translational travel limit.

28. The exercise device according to claim 20 wherein said pulley is disengaged from said support member during said rolling of said roller on said support member.

29. A method for changing an exercise on an exercise device comprising a frame, a press arm pivotally attached to said frame at a main pivot, a pair of press handles extending from said press arm, an adjustment link having a first portion pivotally mounted to said press arm at an adjustment pivot between said main pivot and said press handles and having a second portion adjustably extensible and retractable from said first portion, a bracket mounted to said second portion of said adjustment link and guided by said frame for movement therealong, a pulley mounted to said bracket and receiving a cable trained therearound from a source of resistance, wherein pivotal movement of said press arm by said press handles in a first direction about said main pivot moves said bracket along said frame, which movement is resisted by said source of resistance on said pulley, and wherein during said pivotal movement, said second portion of said adjustment link at said bracket moves along said frame, and wherein said press arm and said press handles are pivotally adjustable relative to said main pivot upon extension and retraction of said second portion of said adjustment link relative to said first portion of said adjustment link, wherein said pulley has a central rotation axis and is mounted to said bracket at said axis, and has a circumferential groove receiving said cable, and has an outer circumference spaced radially outwardly of said groove by a radial dimension greater than the radial thickness of said cable in said groove, and wherein said pulley at said outer circumference engages and rolls along said support member of said frame during said pivotal movement of said press arm about said main pivot, and having a second pulley mounted to said frame below said first mentioned pulley and guiding said cable from said source of resistance to said first pulley, and a cable guide mounted to said frame below said first pulley and guiding said cable from said first pulley, said second pulley and said cable guide training said cable around said first pulley at an orientation providing a direction of force on said first pulley causing said first pulley to ride on said support member such that said first pulley rolls upwardly along said support member and is biased into engagement with said support member during said upward rolling, wherein said first pulley rolls downwardly along said support member as urged by said source of resistance and by gravity to a lower translational travel limit and disengagingly separates from said support member at said lower limit, wherein said cable guide is a third pulley and said cable extends beyond said third pulley to a cable end, said method comprising attaching said cable end to an exercise accessory to pull said cable against the resistance of said source of resistance while said first pulley is at said lower translational travel limit and disengaged from said support member.

30. A method for changing an exercise on an exercise device comprising a frame, a press arm pivotally attached to said frame at a main pivot, a pair of press handles extending from said press arm, an adjustment link having a first portion pivotally mounted to said press arm at an adjustment pivot between said main pivot and said press handles and having a second portion adjustably extensible and retractable from said first portion, a bracket mounted to said second portion of said adjustment link and guided by said frame for movement therealong, a pulley mounted to said bracket and receiving a cable trained therearound from a source of resistance, wherein pivotal movement of said press arm by said press handles in a first direction about said main pivot moves said bracket along said frame, which movement is resisted by said source of resistance on said pulley, and wherein during said pivotal movement, said second portion of said adjustment link at said bracket moves along said frame, and wherein said press arm and said press handles are pivotally adjustable relative to said main pivot upon extension and retraction of said adjustment link relative to said first portion of said adjustment link, and wherein said bracket has a roller engaging and rolling along said support member of said frame during said pivotal movement of said press arm about said main pivot, and having a second pulley mounted to said frame below said first mentioned pulley and guiding said cable from said source of resistance to said first pulley, and a cable guide mounted to said frame below said first pulley and guiding said cable from said first pulley, said second pulley and said cable guide training said cable around said first pulley at an orientation providing a direction of force on said bracket causing said roller to ride on said support member such that said roller rolls upwardly along said support member and is biased into engagement with said support member during said upward rolling, wherein said roller rolls downwardly along said support member as urged by said source of resistance on said first pulley and by gravity to a lower translational travel limit of said bracket, wherein said cable guide is a third pulley and said cable extends beyond said third pulley to a cable end, said method comprising attaching said cable end to an exercise accessory to pull said cable against the resistance of said source of resistance while said bracket is at said lower translational travel limit.

* * * * *